US007836745B2

(12) United States Patent
Tseng et al.

(10) Patent No.: US 7,836,745 B2
(45) Date of Patent: Nov. 23, 2010

(54) METHOD FOR COLD FORGING HIGH STRENGTH FASTENER WITH AUSTENITIC 300 SERIES MATERIAL

(76) Inventors: Yu-Sheng Tseng, No. 148-40. Chung-Lu Road, Ar-Lian Township, Kaohsiung County 822 (TW); Jian-Shiun Tseng, No. 148-40, Chung-Lu Road, Ar-Lian Township, Kaohsiung County 822 (TW)

( * ) Notice: Subject to any disclaimer, the term of this patent is extended or adjusted under 35 U.S.C. 154(b) by 320 days.

(21) Appl. No.: 12/026,091

(22) Filed: Feb. 5, 2008

(65) Prior Publication Data

US 2009/0183546 A1 Jul. 23, 2009

(51) Int. Cl.
*B21D 22/00* (2006.01)

(52) U.S. Cl. ..... 72/356; 470/10; 470/16; 470/66

(58) Field of Classification Search ..... 470/8, 470/9, 10, 11, 12, 16, 17, 57, 58, 66; 148/907; 72/352, 356, 358, 359, 360
See application file for complete search history.

(56) References Cited

U.S. PATENT DOCUMENTS 3,683,436 A * 8/1972 Reiland ..... 470/10
4,233,880 A * 11/1980 Bjorklund et al. ..... 411/387.6
4,718,908 A * 1/1988 Wigginton et al. ..... 623/23.53
4,773,111 A * 9/1988 Hyner et al. ..... 470/9
5,308,286 A * 5/1994 Uejima ..... 470/9
5,340,412 A * 8/1994 Yoshino et al. ..... 148/208
6,017,274 A * 1/2000 Sherman et al. ..... 470/16

FOREIGN PATENT DOCUMENTS

JP 3-9109 * 1/1991
JP 11-50281 * 2/1999

* cited by examiner

*Primary Examiner*—Edward Tolan
(74) *Attorney, Agent, or Firm*—Rosenberg, Klein & Lee

(57) ABSTRACT

The present invention pertains to a method for cold forging high strength fastener with austenitic 300 series material comprising the procedures of initially preparing a raw austenitic shaft and then proceeding through a cold forging method to reduce its diameter for thereafter generating a preliminary shank, which can undertake above ½ force more than the raw shaft; further passing through the following formations of the head, the drilling portion and threads in sequence to build an integral fastener. Thus, the entire cold forging facilitates to fabricate the fastener with high strength and hardness by lower manufacturing cost and with effective corrosion resistance, so as to firmly drill the fastener into objects and increase the screwing security.

3 Claims, 7 Drawing Sheets

METHOD FOR COLD FORGING HIGH STRENGTH FASTENER WITH AUSTENITIC 300 SERIES MATERIAL

BACKGROUND OF THE INVENTION

1. Field of the Invention

The present invention relates to a method of forming a metal fastener, in particular a method for cold forging high strength fastener with austenitic 300 series material.

2. Description of the Related Art

Referring to FIGS. 1 and 2, a conventional method 1 of manufacturing a fastener comprises a sequence of procedures, which include a procedure of preparation 11, a procedure of head formation 12, a procedure of drill point formation 13, a procedure of threads formation 14 and a procedure of heat treatment 15; wherein, a raw shaft 21, made of the austenitic 302 or 304 stainless steel, is initially arranged in the preparation 11 and provides with a first diameter "d" for instance the specification of #12 (approximately of 5.5 mm) and a maximum shearing force approached 2630 pounds. Further, the raw shaft 21 respectively forms a head 23 and a shank 24 extended therefrom and thereafter forms a drilling portion 25 disposed reverse to the head 23 by the formation procedures 12 and 13. Still, a plurality of threads 26 are sequentially convolved on the shank 24 by a thread roller machine, thus obtaining a preliminary fastener. Ultimately, the fastener is susceptible of carburizing and quenching inside a heat furnace for altering the molecular arrangement thereof and is also coated with a carburized layer 27 thereon for increasing the hardness thereof. The above apparatuses here are omitted in Figures.

However, the conventional method may have some disadvantages:

1. Higher Manufacturing Cost and More Procedures

Although the integral fastener includes higher strength than the raw shaft through the concatenating procedures of formations, the fastener still requires the heat treating procedure to enhance its case hardness, so that the fastener can be smoothly drilled into objects. Additionally, the fastener would facilely become rusty and corrosive by the carburized layer and the additional process for corrosion resistance is necessary, whereby the conventional method results of increasing the cost and adding more excess manufacturing procedures.

2. Descending the Quality of the Fastener

The procedure of heat treatment may assist the fastener to increase its case hardness but may negatively soften its core hardness susceptible of the high temperature in carburizing and quenching, thus decreasing the elongation of the fastener to result in the broken thereof or difficultly drilling the fastener into objects. Therefore, it would affect the screwing security.

SUMMARY OF THE INVENTION

The object of the present invention is to provide a method for cold forging high strength fastener with austenitic 300 series material which facilitates to achieve a high strength and an effective corrosion resistance, simultaneously to obtain a rapid manufacture, a lower manufacturing cost and the using security.

The method in accordance with the present invention comprises in sequence a procedure of preparation, a procedure of head formation, a procedure of drill point formation, and a procedure of thread formation. That is, preparing an austenitic raw shaft and reducing its diameter by cold forging so as to generate a preliminary shank, which can bear above ½ force more than the raw shaft; further passing through the formation procedures in sequence to build an integral fastener. In this manner, the entire cold forging work facilitates to fabricate the integral fastener with high strength and harness without any additional heating procedures, thus decreasing the manufacturing cost and process; moreover, the fastener has a better elongation to avoid being broken while screwing so as to increase the screwing security.

The advantages of the present invention over the known prior art will become more apparent to those of ordinary skilled in the art upon reading the following descriptions in junction with the accompanying drawings.

DETAILED DESCRIPTION OF THE PREFERRED EMBODIMENTS

Figure 1:
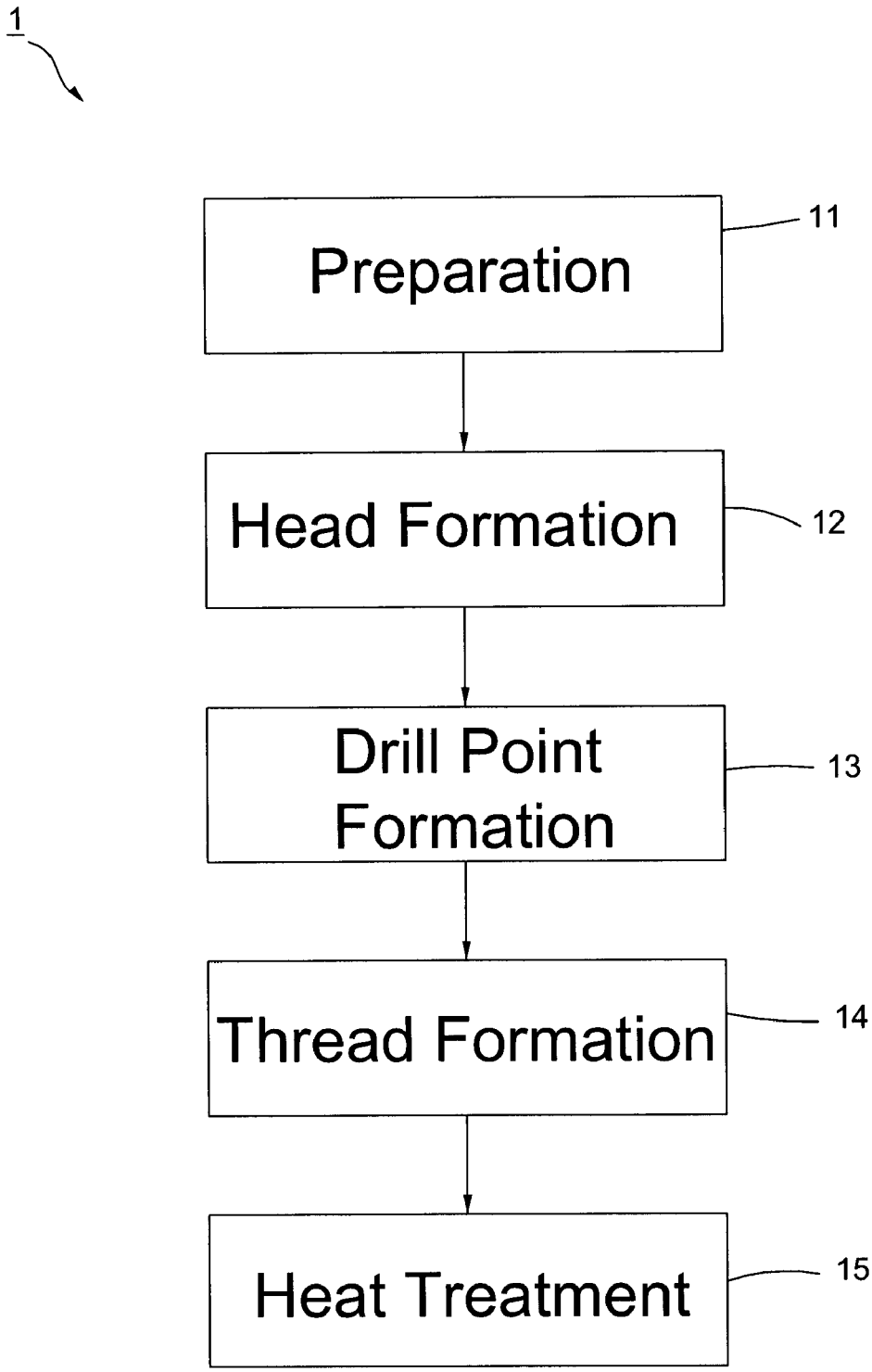
FIG. 1 ( PRIOR ART)
FIG. 1 is a flow diagram showing a conventional method of manufacturing a stainless fastener.
Figure 2:
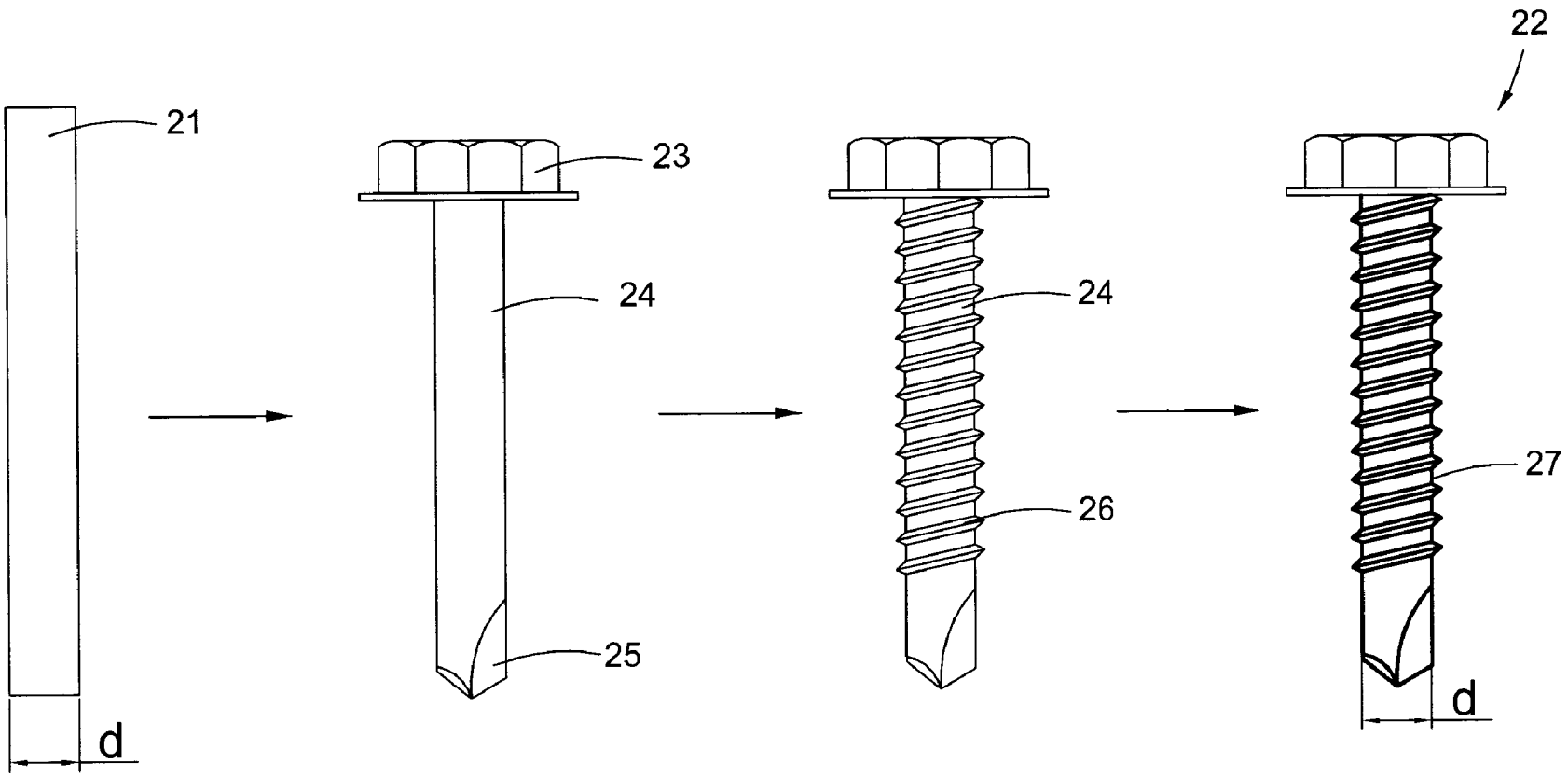
FIG. 2 ( PRIOR ART)
FIG. 2 is a schematic view showing the conventional procedures.

Before the present invention is described in greater detail, it should be noted that the like elements are denoted by the same reference numerals throughout the disclosure.

Figure 3:
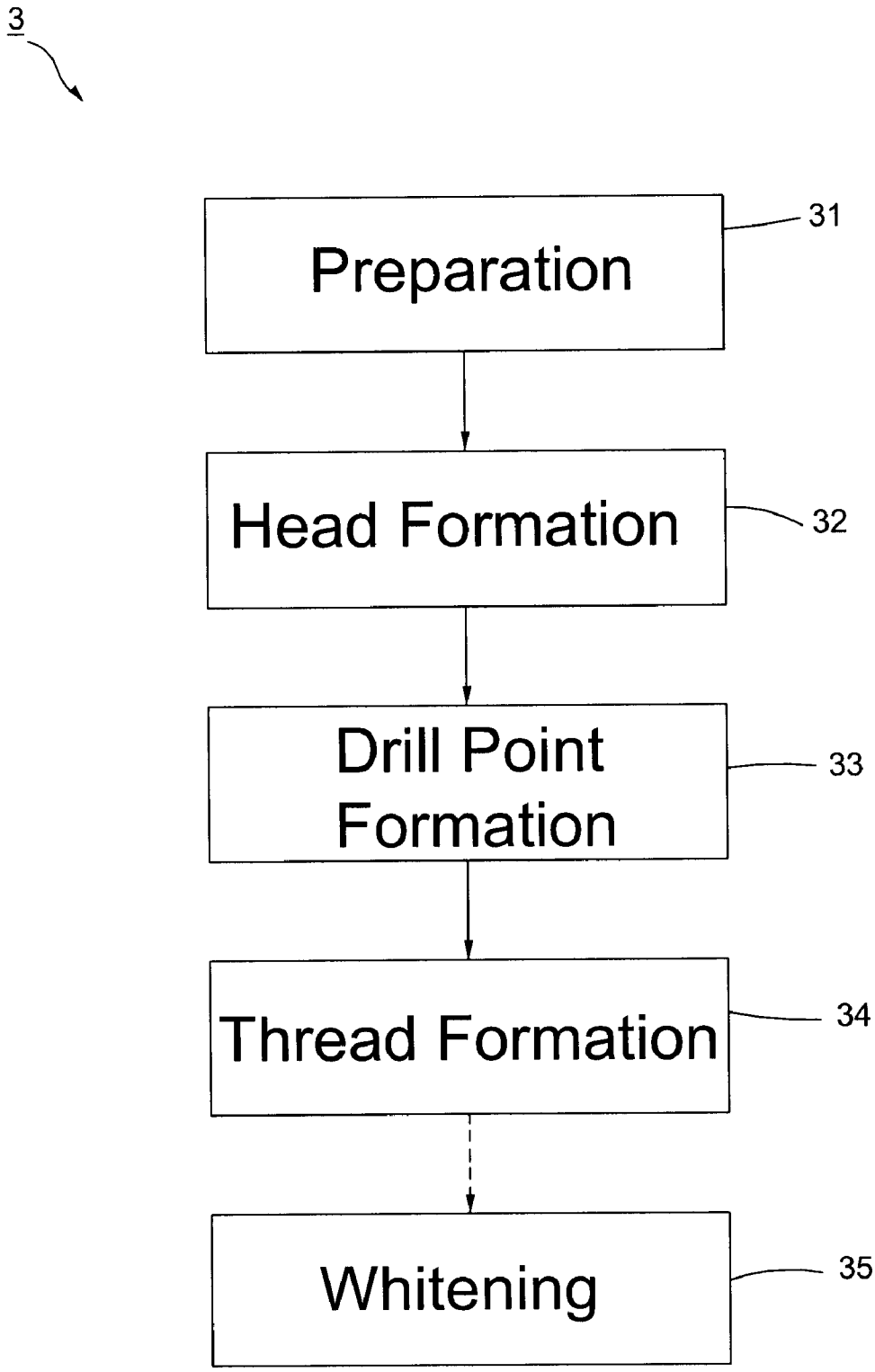
FIG. 3 is a flow diagram showing a first preferred embodiment of the present invention.
Figure 4:
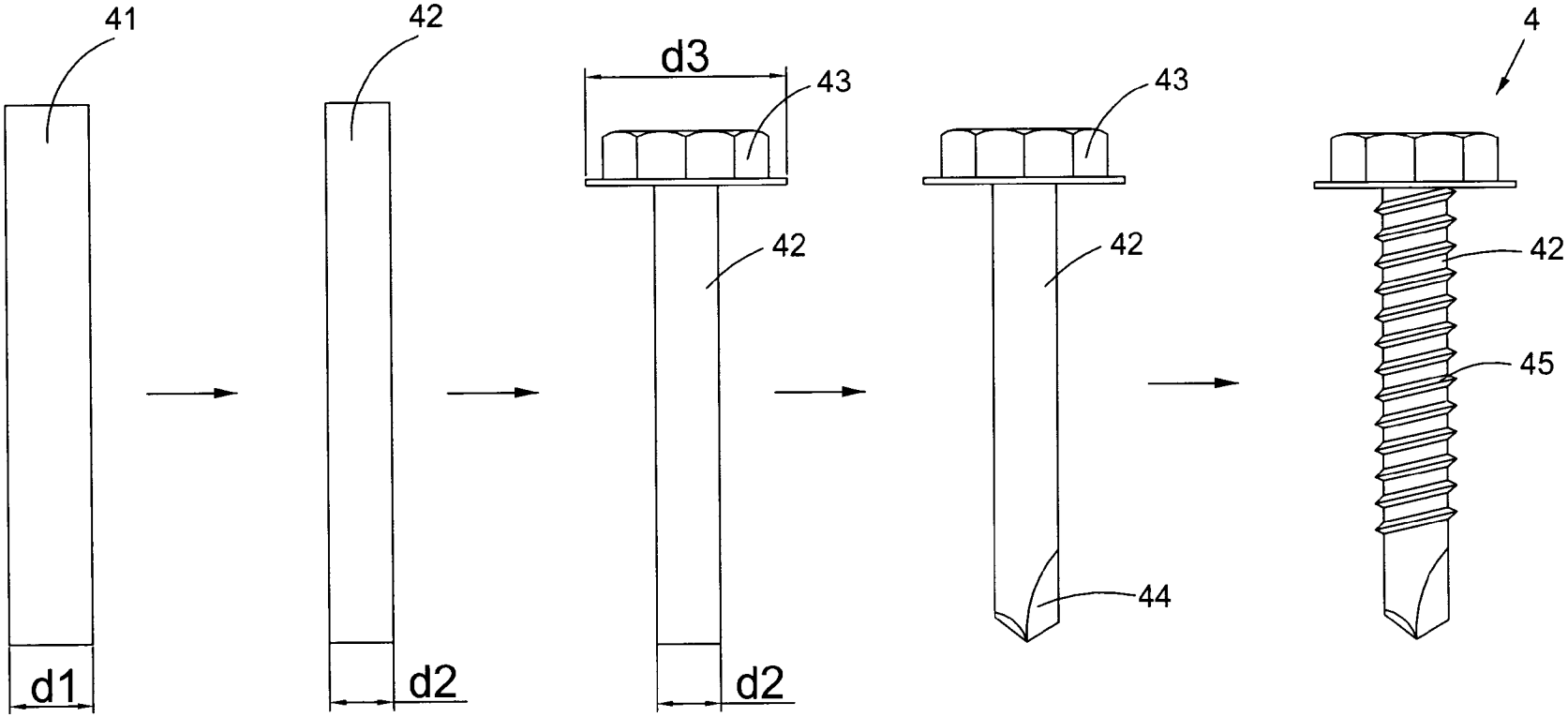
FIG. 4 is a schematic view for showing the procedures of FIG. 3.

Referring to FIGS. 3 and 4, a method 3 of a first preferred embodiment for cold forging a high strength fastener comprises the steps of a process of preparation 31 for preparing a raw shaft 41 having a first diameter "d1" fabricated of austenitic 300 series material, for instance of 302 or 304 stainless steel, and the raw shaft 41 is initially squeezed by cold forging for reducing above 15% of the first diameter "d1" and a preliminary shank 42 with a second diameter "d2" is hence generated. Assumed that the second diameter "d2" is measured of 5.5 mm, and the first diameter should be predetermined at least of 6.325 mm, so that the second diameter "d2" smaller than the first diameter "d1" assists the shank 42 to undertake in excess of ½ force to the raw shaft 41, namely the shank 42 is subjected to the maximum shearing force of 4065.25 pounds, extremely larger than the conventional method (2630 pounds).

Still further, the preliminary shank 42 forms a screw head 43 at one end thereof through a procedure of head formation 32 and the head 43 has a third diameter "d3" greater than the second diameter "d2" of the shank 42. In a procedure of drill point formation 33, a drilling portion 44 is thereafter cold forged at the other end of the shank 42, reverse to the head 43, so as to increase the hardness of the drilling portion 44. Further at a procedure of thread formation 34, a plurality of screw threads 45 are convolved on the shank 42 by a thread roller machine (not shown), hence an integral fastener 4 is accomplished. The fastener 4 increases its case hardness and strength by passing from the cold forging of the preparation 31, thence to the head and the drill point formation 32, 33, and then to the thread forming formation 34 to impart multiple squeezing forces to the shank 42. Furthermore, the integral fastener 4 can additionally experience a procedure of whitening 35 for cleaning the remnants on the outer surface thereof, thereby retrieving primary colors of the raw austenitic 300 series materials and maintaining a bright appearance.

Figure 5A:
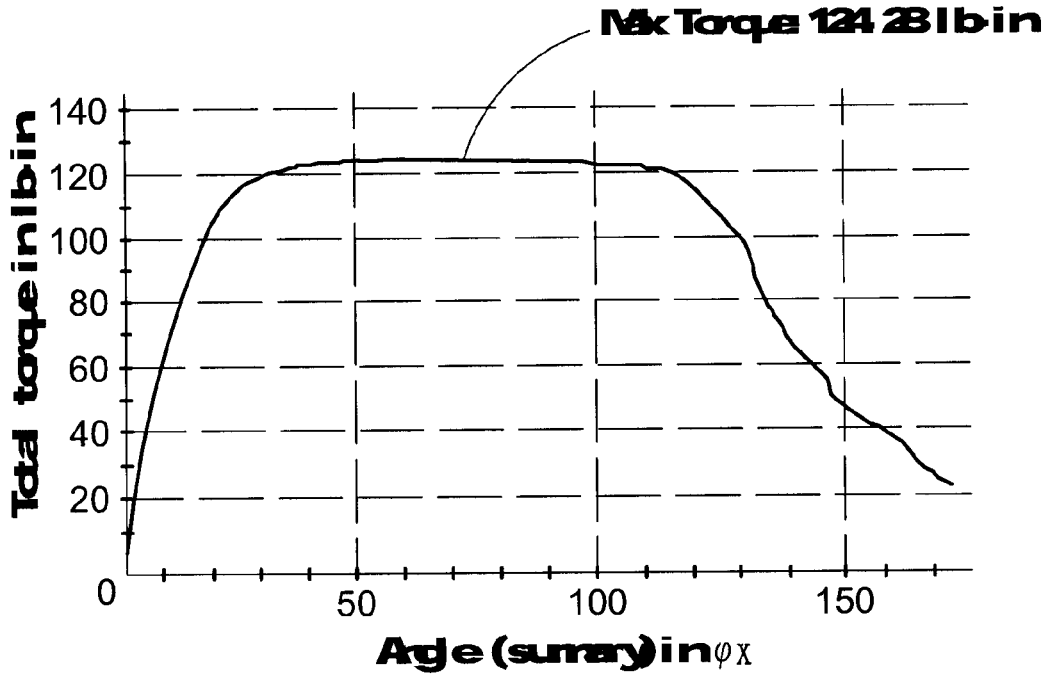
FIGS. 5*a* and 5*b* respective indicate the torque range in the experiment relating to the torque value and the angle.
Figure 5B:
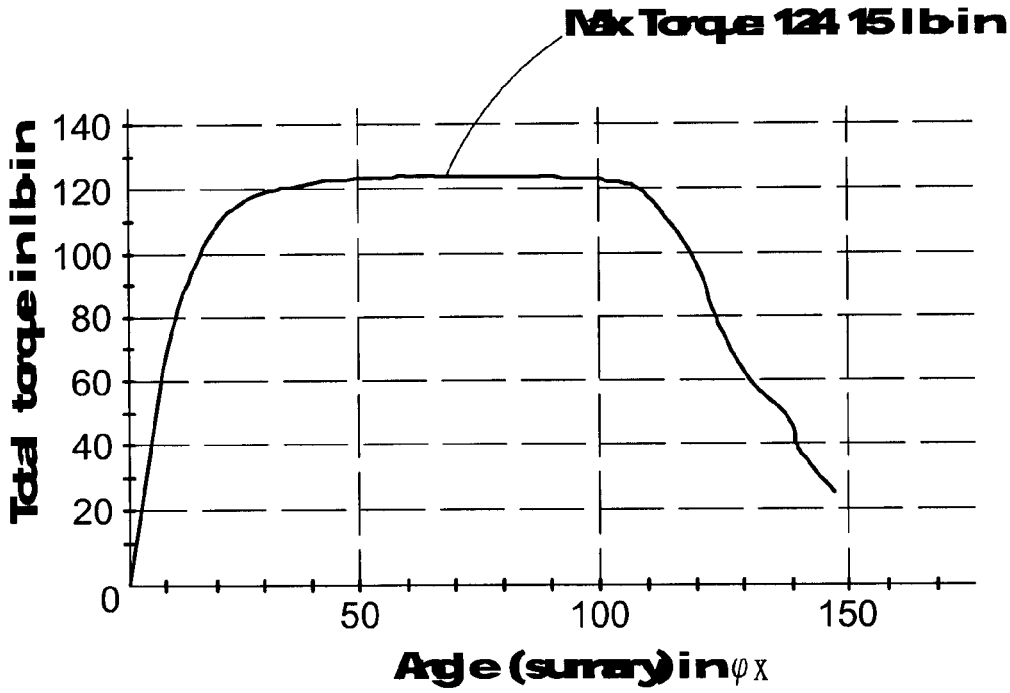

Moreover, the fastener 4 has been previously tested in different areas and provides with some experimental statistics as presented in tabled below:

(1) For Utilized in Construction Industry 8 random samples of fasteners made by the present invention and providing with the specification of #12×35 are adopted in the experiment and here the table 1 shows the numerals relative to the hardness, torque, shearing force and loading weight while in screwing: (Referring to FIGS. 5*a* and 5*b*)

TABLE 1

| CHARACTERISTICS | RESULTS | REFERENCE |
|---|---|---|
| Surface Hardness-Thread | 402~423 HV0.3 | |
| Surface Hardness-Drill Point | 395~432 HV0.3 | |
| Torsional Strength | 124.15~124.28 in · lb (Maximum value) | Equating with 143.08~143.20 kg · cm (metric system) |
| Shearing Force | 4065.25 pounds | |
| Loading weight | 6045 pounds | |

(2) For Utilized in Automotive Industry 8 random samples of fasteners made by the present invention and providing with the specification of M8×1.25×32 mm are adopted in the experiment and here the table 2 shows the practical numerals by comparing to the standard level:

TABLE 2

| CHARATERISTICS | RESULTS | STANDARD VALUE |
|---|---|---|
| Core Hardness | 37-38 HRC | 33-39 HRC |
| Axial Tensile Strength | 124-125 kg/mm2 | 110 Min · kg/mm2 |
| Elongation | 12-14% | 10 MIN · % |

In view of the austenitic 300 series materials devoid of the enough strength, the standard value of TABLE 2 is defined according to the value of the fasteners fabricated of iron materials. From the table 2, the elongation and the axial tensile strength of the present invention obviously exceeds the standard level except for the core hardness being located within the range of the level, which indicates the fastener can be well adapted to the automotive demand. Those numerals of the two charts indicate that the present invention is adapted to the relative fields and provides with high hardness and high strength.

(3) Inspection on Corrosion Test

Figure 6:
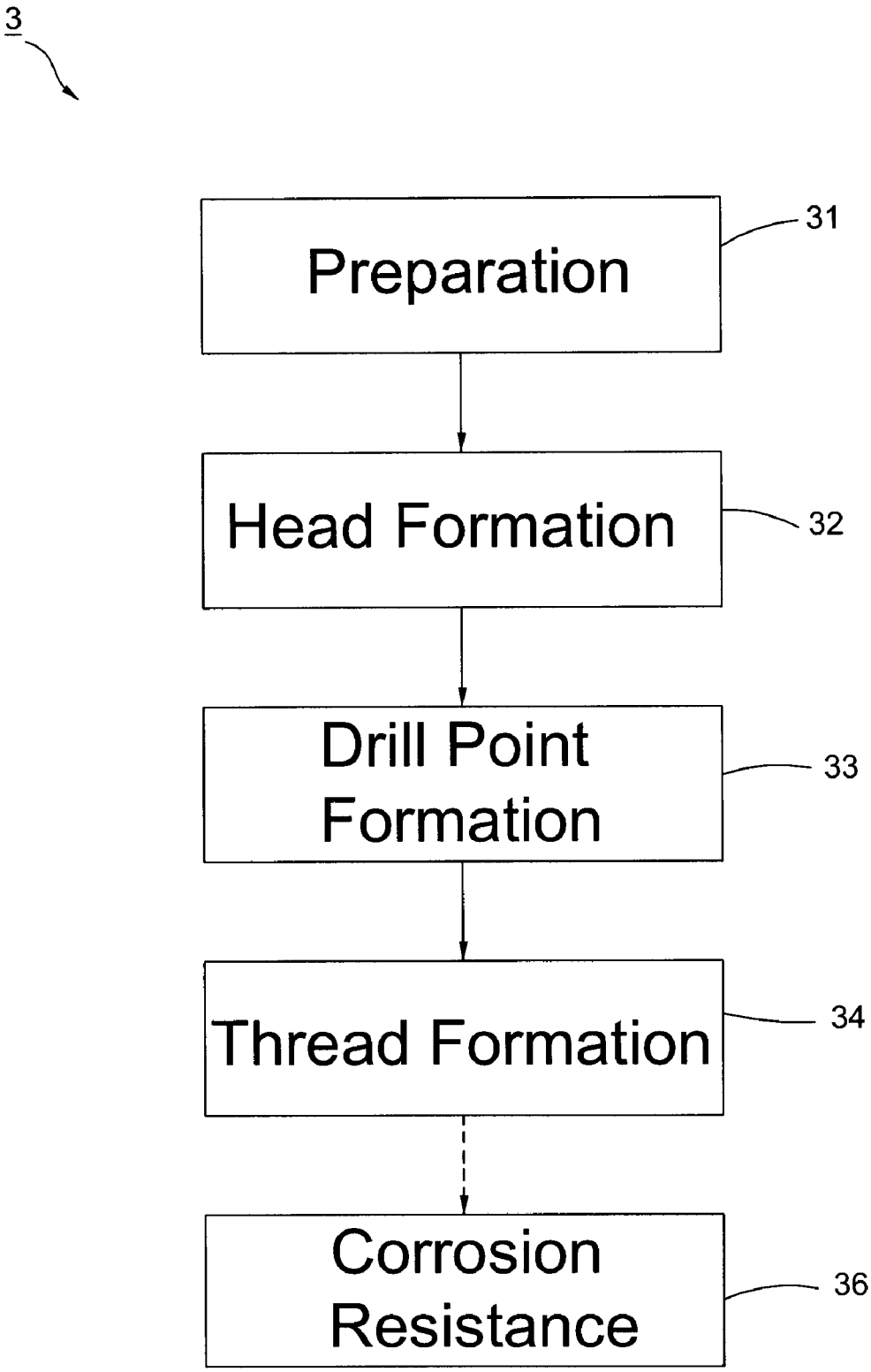
FIG. 6 is a flow diagram showing a second preferred embodiment of the present invention.
Figure 7:
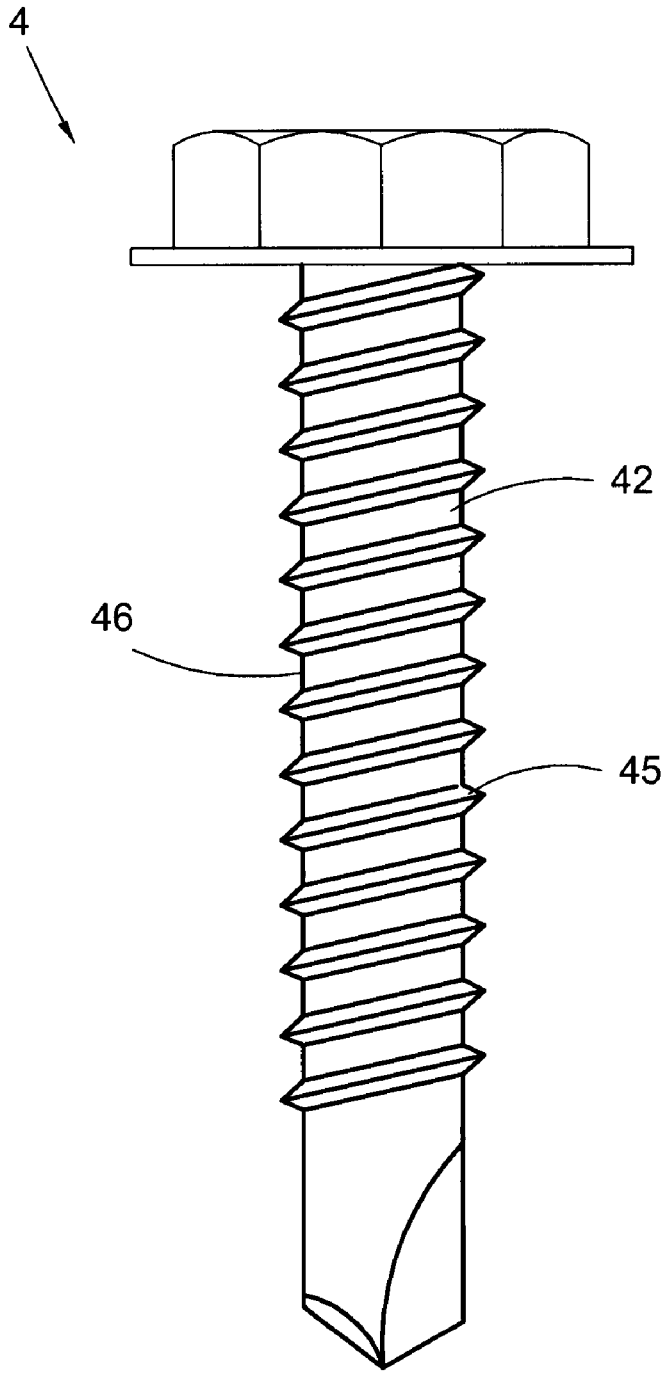
FIG. 7 is a schematic view shown an integral fastener of FIG. 6.

Further, the experiment carries out both Salt Spray Test and Kesternich Test procedure per DIN 50018 for corrosion tests, and the results indicate that the fastener does not appear patches of rust and corrosion thereon. Therefore, the fastener of the present invention substantially achieves a better corrosion resistance. Referring to FIG. 6, a second preferred embodiment of the present invention still comprises the same procedures of preparation 31, the head formation 32, the drill point formation 33 and threads formation 34. Particularly, a procedure of corrosion resistance 36 can be carried out after the threads forming procedure 34 depend on the market demand in order to coat with a rust-resistant layer 46 (as shown in FIG. 7) on an outer surface of the integral fastener 4 for achieving superior corrosion protection.

In view of the above descriptions, the present invention has following advantages:

1. Higher Strength without Proceeding Heat Treatment

By means of the procedure of preparation, the raw shaft is initially squeezed by cold forging to generate a preliminary shank with a smaller diameter, which results of the shank providing with higher density and strength for bearing above ½ force greater than the raw shaft. The subsequent procedures of formations also experience the conformity forging method with the initially process so as to avoid breaking the molecular arrangements of the austenitic materials and simultaneous reinforce the strength and hardness for the fastener to be firmly drilled into the objects.

2. Effective Corrosion Resistance and more Screwing Security

Due to that the fastener is not susceptible of the carburizing and quenching, the present invention is conducive to raise the producing speed and reduce the manufacturing cost. Additionally, the core and case hardness of the fastener would not be influenced while being devoid of the heat treatment procedure and the fastener would increase its corrosion resistance without being carburized, hence the present invention can have better elongation to prevent an unintentional broken, increase the screwing security and achieve better corrosion resisting effect.

To sum up, the present invention takes advantage of cold forging for initially preparing a preliminary shank with higher core and case hardness and subsequently passing through the head, the drilling portion and threads formations to generate the integral fastener with high strength and hardness. In this manner, the present invention deviates from the conventional heat treatment, which facilitates to decrease the manufacturing cost, improve the corrosion situation and simultaneously enhance the screwing security.

While we have shown and described the embodiment in accordance with the present invention, it should be clear to those skilled in the art that further embodiments may be made without departing from the scope of the present invention.

We claim:

1. A method for cold forging high strength fastener with austenitic 300 series material comprising the steps of:

preparing a raw austenitic 300 series shaft having a first diameter, said first diameter being initially squeezed by cold forging for reducing above 15% of said first diameter for generating a preliminary shank, said preliminary shank having a second diameter smaller than said first diameter and being capable of bearing a force 50% greater than said raw shaft;

forming a head by forming a screw head at one end of said shank;

forming a drill point by forging a drilling portion at the other end of said shank, opposite to said screw head; and forming threads by continuously rolling a plurality of screw threads between said head and said drilling portion, hence an integral fastener is accomplished.

2. The method as claimed in claimed 1, wherein, a procedure of whitening is subsequently proceeding after said procedure of thread formation for retrieving primary colors of raw austenitic 300 series materials.

3. The method as claimed in claimed 1, wherein, a procedure of corrosion resistance is subsequently proceeding after said procedure of thread formation in order to coat with a rust-resistant layer on an outer surface of said integral fastener for corrosion protection.

* * * * *